US010187954B2

(12) United States Patent
Matsubayashi et al.

(10) Patent No.: US 10,187,954 B2
(45) Date of Patent: Jan. 22, 2019

(54) LIGHTING APPARATUS FOR DISPLAY ILLUMINATION

(71) Applicant: PANASONIC INTELLECTUAL PROPERTY MANAGEMENT CO., LTD., Osaka (JP)

(72) Inventors: Yoko Matsubayashi, Osaka (JP); Kazuki Harada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/806,870

(22) Filed: Nov. 8, 2017

(65) Prior Publication Data

US 2018/0153018 A1 May 31, 2018

(30) Foreign Application Priority Data

Nov. 29, 2016 (JP) ..... 2016-231884

(51) Int. Cl.

| | |
|---|---|
| ***F21S 8/04*** | (2006.01) |
| ***H05B 33/08*** | (2006.01) |
| ***F21V 3/00*** | (2015.01) |
| ***F21V 19/00*** | (2006.01) |
| *F21Y 103/10* | (2016.01) |
| *F21Y 115/10* | (2016.01) |
| *F21Y 113/13* | (2016.01) |

(52) U.S. Cl.

CPC ..... *H05B 33/0872* (2013.01); *F21S 8/04* (2013.01); *F21V 3/00* (2013.01); *F21V 19/003* (2013.01); *F21V 19/0015* (2013.01); *H05B 33/0854* (2013.01); *F21Y 2103/10* (2016.08); *F21Y 2113/13* (2016.08); *F21Y 2115/10* (2016.08)

(58) Field of Classification Search

CPC ... F21S 8/04; H05B 33/0872; H05B 33/0854; F21Y 2113/10; F21Y 2113/13; F21Y 2103/10

See application file for complete search history.

(56) References Cited

U.S. PATENT DOCUMENTS

| | | | | |
|---|---|---|---|---|
| 9,544,968 | B2 * | 1/2017 | Matsubayashi .... | H05B 33/0857 |
| 9,797,576 | B2 * | 10/2017 | Matsubayashi ..... | F21V 9/30 |
| 9,913,340 | B2 * | 3/2018 | Liu ..... | H05B 33/0872 |
| 2013/0162140 | A1 | 6/2013 | Shamoto et al. | |
| 2013/0300282 | A1 | 11/2013 | Mori et al. | |

(Continued)

FOREIGN PATENT DOCUMENTS

| | | |
|---|---|---|
| JP | 2006-349835 | 12/2006 |
| JP | 2009-260390 | 11/2009 |

(Continued)

*Primary Examiner* — Karabi Guharay

(74) *Attorney, Agent, or Firm* — Greenblum & Bernstein, P.L.C.

(57) ABSTRACT

A lighting apparatus includes a light emitter that emits a first illumination light as a display illumination light. The optical characteristics of the first illumination light are: a correlated color temperature in a range from 3800 K to 6500 K, inclusive; chromaticity deviation Duv in a range from −9 to 0, inclusive; and an intrinsic photosensitive retinal ganglion cell (ipRGC) stimulus level of at least 0.6, the ipRGC stimulus level being a value standardized by setting an ipRGC stimulus level of light emitted from a D65 light source to 1.

7 Claims, 20 Drawing Sheets

(56) References Cited

U.S. PATENT DOCUMENTS

| | | | |
|---|---|---|---|
| 2016/0076709 | A1 | 3/2016 | Matsubayashi et al. |
| 2017/0257922 | A1* | 9/2017 | Matsubayashi ..... F21V 3/00 |

FOREIGN PATENT DOCUMENTS

| | | |
|---|---|---|
| JP | 2011-072388 | 4/2011 |
| JP | 2012-064925 | 3/2012 |
| JP | 2012-155906 | 8/2012 |
| JP | 2014-075186 | 4/2014 |
| JP | 2015-026585 | 2/2015 |
| JP | 2016-096055 | 5/2015 |
| JP | 2016-062887 | 4/2016 |
| JP | 2016-095998 | 5/2016 |
| WO | 2012/104937 | 8/2012 |

* cited by examiner

LIGHTING APPARATUS FOR DISPLAY ILLUMINATION

CROSS REFERENCE TO RELATED APPLICATION

This application claims the benefit of priority of Japanese Patent Application Number 2016-231884 filed on Nov. 29, 2016, the entire content of which is hereby incorporated by reference.

BACKGROUND

1. Technical Field

The present disclosure relates to lighting apparatuses, and particularly to a lighting apparatus capable of improving readability perception of characters in a display.

2. Description of the Related Art

Various studies are being carried out regarding ambient light used when a user performs work. For example, during a visual task of looking at characters in documents, etc., on a table, a lighting apparatus is used for enhancing the legibility of the characters. Conventionally, a lighting apparatus that emits illumination light which enhances the whiteness perception of a document to facilitate readability of characters in the document has been proposed (see Japanese Unexamined Patent Application Publication No. 2014-075186).

SUMMARY

Up to now, there has not been any recommendation for ambient light suitable for a display, and it cannot be said that characters on a display are easy to read with the illumination light of conventional lighting apparatuses.

The present disclosure provides a lighting apparatus capable of improving the readability perception of characters on a display.

A lighting apparatus according to an aspect of the present disclosure includes a light emitter that emits a first illumination light as a display illumination light, wherein the first illumination light has, as optical characteristics: a correlated color temperature in a range from 3800 K to 6500 K, inclusive; chromaticity deviation Duv in a range from −9 to 0, inclusive; and an intrinsic photosensitive retinal ganglion cell (ipRGC) stimulus level of at least 0.6, the ipRGC stimulus level being a value standardized by setting an ipRGC stimulus level of light emitted from a D65 light source to 1.

It is possible to improve readability perception of characters on a display.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

An exemplary embodiment of the present disclosure is described below. It should be noted that the subsequently-described exemplary embodiment shows a specific example. Therefore, numerical values, structural components, the arrangement and connection of the structural components, as well as steps and the sequence of the steps, etc. shown in the following embodiment are mere examples, and are not intended to limit the scope of the present disclosure. Furthermore, among the structural components in the following embodiments, components not recited in any one of the independent claims which indicate the broadest concepts of the present disclosure are described as arbitrary structural components.

Furthermore, the respective figures are schematic diagrams and are not necessarily precise illustrations. Furthermore, in the respective figures, substantially identical components are assigned the same reference signs, and overlapping description is omitted or simplified.

In addition, in the Specification and Drawings, the X-axis, the Y-axis, and the Z-axis represent the three axes in a three-dimensional orthogonal coordinate system. In the embodiment, the Z-axis direction is the vertical direction, and a direction perpendicular to the Z-axis (i.e., a direction parallel to an XY plane) is a horizontal direction. The X-axis and the Y-axis are orthogonal to each other, and each is an axis that is orthogonal to the Z-axis.

Embodiment

Figure 1:
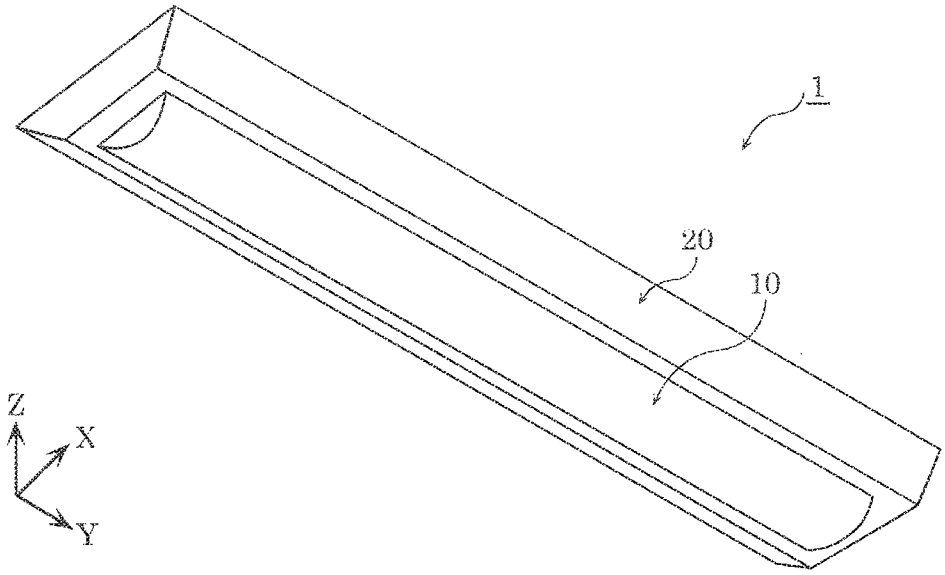
FIG. 1 is a perspective view of a lighting apparatus according to an embodiment.
Figure 2:
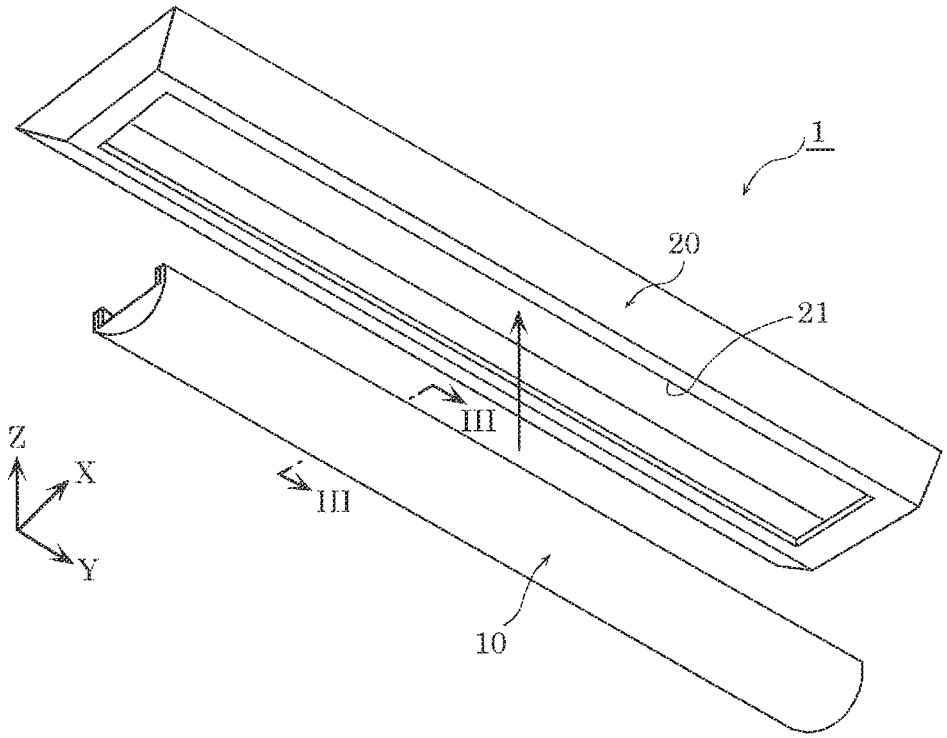
FIG. 2 is an exploded perspective view of the lighting apparatus according to the embodiment.

First, an overall configuration of lighting apparatus 1 according to an embodiment will be described with reference to FIG. 1 and FIG. 2. FIG. 1 is a perspective view of lighting apparatus 1 according to this embodiment. FIG. 2 is an exploded perspective view of lighting apparatus 1.

Lighting apparatus 1 is a luminaire that is attached to a building part such as a ceiling or a wall. In this embodiment, lighting apparatus 1 is for example an elongated ceiling light and emits white light as illumination light.

As illustrated in FIG. 1 and FIG. 2, lighting apparatus 1 includes light source unit 10 and fixture body 20.

Light source unit 10 emits white light according to powers supplied from a power supply device. The power supply device may be provided inside lighting apparatus 1 or may be disposed outside of lighting apparatus 1. As illustrated in FIG. 2, light source unit 10 is fixed to opening portion 21 of fixture body 20.

Fixture body 20 is a holding component that holds light source unit 10, and is, for example, fixed to the ceiling using a hanger bolt, etc. Fixture body 20 is made of sheet metal for example, and is formed in the shape of an elongated, flat, spread-out box by bending, etc. of the sheet metal. Elongated rectangular opening portion 21 is provided in the bottom face of fixture body 20.

In this embodiment, lighting apparatus 1 has, as light emission modes, a display illumination mode (first mode) in which a first illumination light is emitted from light source unit 10, and a document illumination mode (second mode) in which a second illumination light is emitted from light source unit 10. The light emitting mode of lighting apparatus 1 can be switched by switching between the display illumination mode and the document illumination mode.

Figure 3:
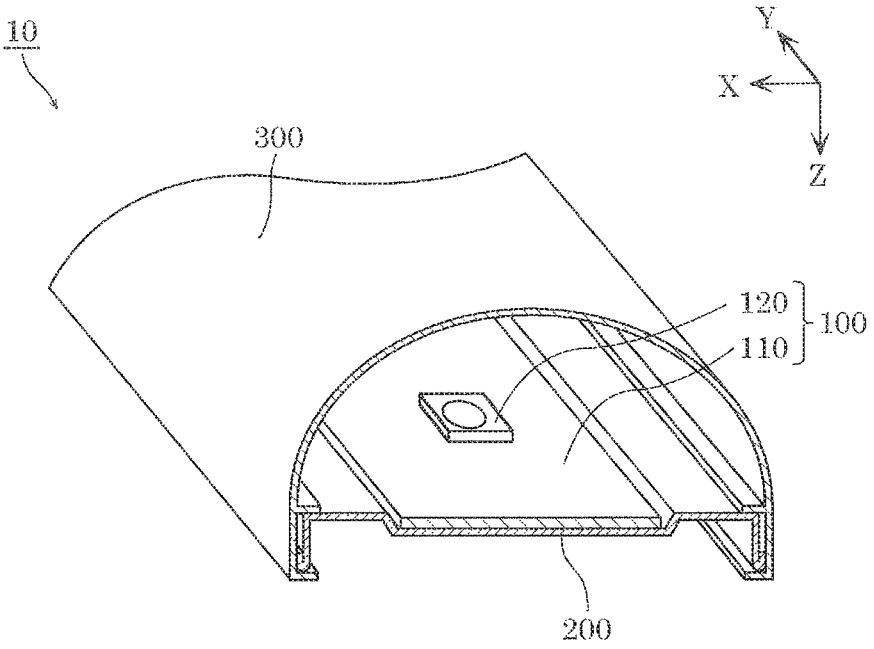
FIG. 3 is a cross-sectional perspective view of a light source unit in the lighting apparatus according to the embodiment.
Figure 4:
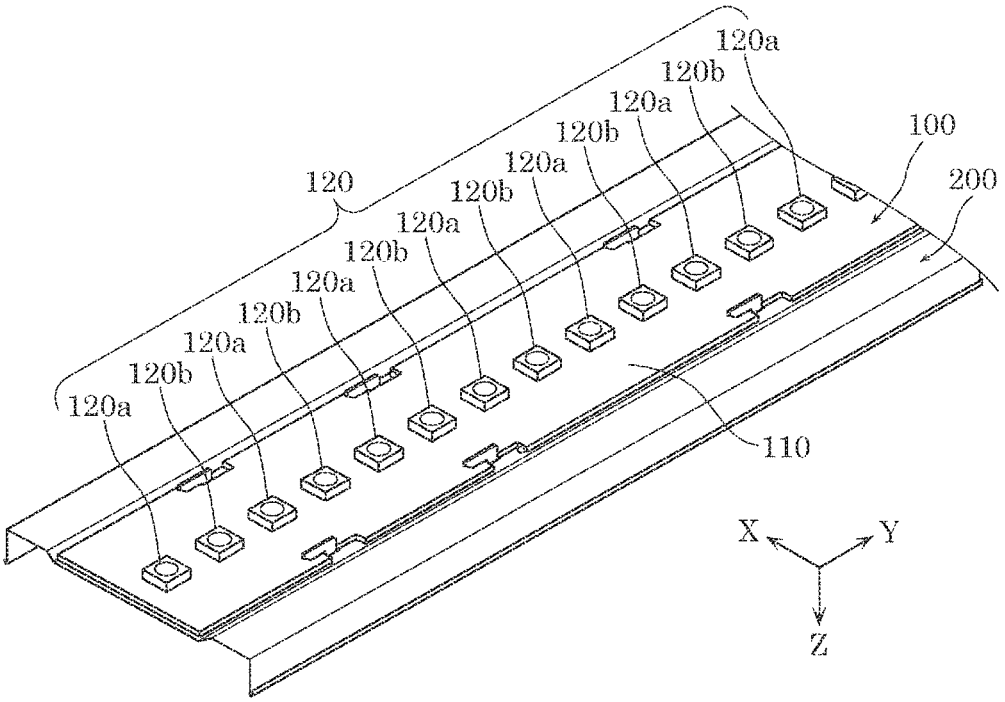
FIG. 4 is a perspective view of the light source unit in the lighting apparatus according to the embodiment, as seen from the light emitter side.

Next, the detailed configuration of light source unit 10 will be described with reference to FIG. 3 and FIG. 4. FIG. 3 is a cross-sectional perspective view of light source unit 10 in lighting apparatus 1 according to the embodiment, and illustrates the cross-section along line III-III in FIG. 2. FIG. 4 is a perspective view of light source unit 10 as seen from light emitter 100 side.

As illustrated in FIG. 3, light source unit 10 includes light emitter 100, base 200 which supports light emitter 100, and light-transmissive cover 300 which covers light emitter 100.

Light emitter 100 is a light source having solid-state light-emitting elements. Specifically, light emitter 100 is a light emitting diode (LED) module having LEDs as solid-state light-emitting elements, and emits white light as illumination light. Light emitter 100 is attached to base 200.

As illustrated in FIG. 3 and FIG. 4, light emitter 100 includes substrate 110 and LED elements 120 disposed on substrate 110. Light emitter 100 in this embodiment is a surface mount device (SMD) light-emitting module, and LED elements 120 are mounted on substrate 110.

Substrate 110 is a mounting board for the mounting of LED elements 120. Substrate 110 is for example a long rectangular substrate, and is for example a resin substrate, a metal base substrate, or a ceramic substrate. Substrate 110 is placed on base 200 and fixed to base 200.

For example, LED elements 120 are mounted in a straight line and at a predetermined interval, along the lengthwise direction of substrate 110.

In this embodiment, each LED element 120 is an SMD light-emitting element and includes a container (package) made of resin, etc., an LED chip (bare chip) placed inside the container, and a sealing component that seals the LED chip.

Each LED element 120 is a white LED element that emits white light; a blue LED chip that emits blue light when energized is used as an LED chip, and a silicone resin (phosphor-containing resin) containing yellow phosphor and red phosphor is used as the sealing component that is filled into the container, for example.

As illustrated in FIG. 4, LED elements 120 consists of first LED elements **120*a* and second LED elements 120*b* which have a lower color temperature than first LED elements 120*a*. In this embodiment, first LED elements 120*a* and second LED elements 120*b* are arranged alternately one at a time, but the order and number in which first LED elements 120*a* and second LED elements 120*b*** are arranged is not limited to such.

First LED elements **120*a* are white LED light sources that emit white light having a correlated color temperature of at least 5000 K and at most 7200 K. Furthermore, second LED elements 120*b*** are white LED light sources that emit white light having a correlated color temperature of at least 2700 K and at most 3800 K.

Figure 5:
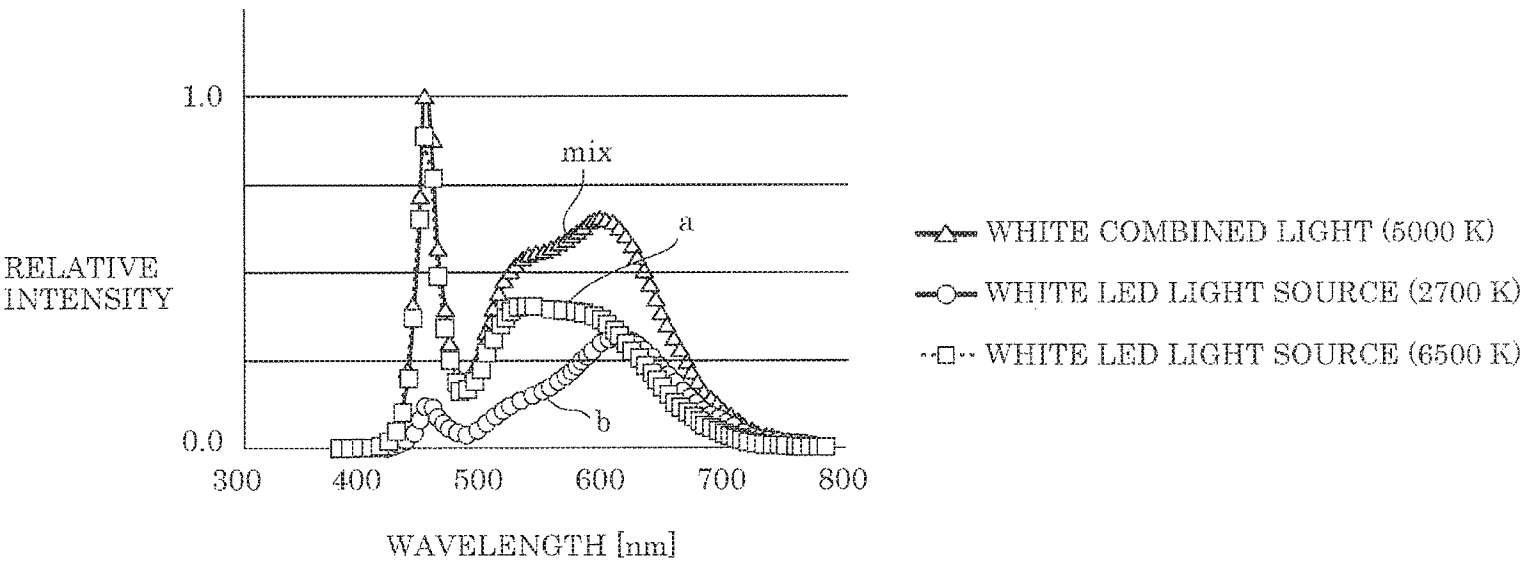
FIG. 5 is a graph illustrating a spectral distribution of the light emitter and LED elements of the lighting apparatus according to the embodiment.

In this embodiment, first LED elements **120*a* emit light having a correlated color temperature of 6500 K and spectral distribution "a" illustrated in FIG. 5. Furthermore, second LED elements 120*b* emit light having a correlated color temperature of 2700 K and spectral distribution "b" illustrated in FIG. 5. In this case, when first LED elements 120*a* and second LED elements 120*b* emit light, light emitter 100 emits light that can realize a correlated color temperature of 5000 K and have spectral distribution "mix" illustrated in FIG. 5**.

Furthermore, light emitter 100 is toning-controllable and its color temperature can be changed. For example, by dimming each of first LED elements **120*a* and second LED elements 120*b*, light emitter 100 can be toned to have a correlated color temperature in a range from 2700 K to 6500 K, inclusive. It should be noted that by setting the correlated color temperature of first LED elements 120*a* to 7200 K, light emitter 100** can be toned to have a correlated color temperature in a range from 2700 K to 7200 K, inclusive.

Light emitter 100 emits the first illumination light as a display illumination light. The optical characteristics of the first illumination light are as follows: correlated color temperature is in a range from 3800 K to 6500 K, inclusive; chromaticity deviation Duv is in a range from −9 to 0, inclusive; and intrinsic photosensitive retinal ganglion cell (ipRGC) stimulus amount, which is a value standardized by setting an ipRGC stimulus level of light emitted from a D65 light source to 1, is at least 0.6.

Furthermore, light emitter 100 emits the second illumination light as the document illumination light (document reading/writing illumination light). The optical characteristics of the second illumination light are as follows: correlated color temperature is in a range from 5400 K to 7000 K, inclusive; chromaticity deviation Duv is in a range from −6 to 8, and chroma value calculated using a calculating method prescribed by the CIE 1997 Interim Colour Appearance Model (Simple Version) is at most 2.

Light emitter 100 configured as described above is attached to base 200. Specifically, substrate 110 of light emitter 100 is fixed to base 200. Base 200 is an elongated metal case and can be formed, for example, by applying processing such as bending on SPCC (Steel Plate Cold Commercial) sheet metal (metal plate).

As illustrated in FIG. 3, light emitter 100 attached to base 200 is covered by light-transmissive cover 300. Light-transmissive cover 300 is a light-transmissive cover component that transmits the light from light emitter 100 (LED elements 120). Light-transmissive cover 300 has for example a substantially semi-cylindrical shape that is elongated.

Light-transmissive cover 300 is configured from a light-transmissive resin material such as acrylic or polycarbonate or a light-transmissive material such as a glass material.

Light-transmissive cover 300 may further have a light-diffusing property (light-scattering property). In other words, light-transmissive cover 300 may be a diffusing cover that is light-transmissive and light-diffusing, and not a transparent cover. By providing light-transmissive cover 300 with a light-diffusing property, the light of LED elements 120 which has high directivity can be scattered, and thus it is possible to suppress the graininess (luminance unevenness) caused by the difference in brightness and darkness of LED elements 120.

Light-transmissive cover 300 can be provided with a light-diffusing property by, for example, forming light-transmissive cover 300 by dispersing a light-diffusing material such as light-reflecting particles in a light-transmissive material, or by forming a milky-white light-diffusing film including a light-diffusing material, etc., on the surface (inner face or outer face) of light-transmissive cover 300 made from a transmissive component. Alternatively, instead of using a light-diffusing material, light-transmissive cover 300 may be provided with a light-diffusing property by forming fine unevenness on the surface of light-transmissive cover 300 by applying embossing on light-transmissive cover 300 made from a transparent component, or by printing a dot pattern on the surface of light-transmissive cover 300 made from a transparent component.

Here, the features of the optical characteristics of the illumination light emitted by lighting apparatus 1, as well as the circumstances leading to the present disclosure will be described in detail below.

Up to now, studies have been carried out regarding ambient light which enhances the whiteness perception of a document to facilitate readability of characters in the document but there has not been any recommendation for ambient light suitable for characters on a display, and ambient light which facilitates readability of characters on a display is difficult to obtain from conventional lighting apparatuses.

Furthermore, although a display has a function which enables a user to manually adjust the brightness and contrast of the screen, the screen settings of the display are often left in the initial state because the user does not know what conditions are suitable for ambient light.

Figure 6:
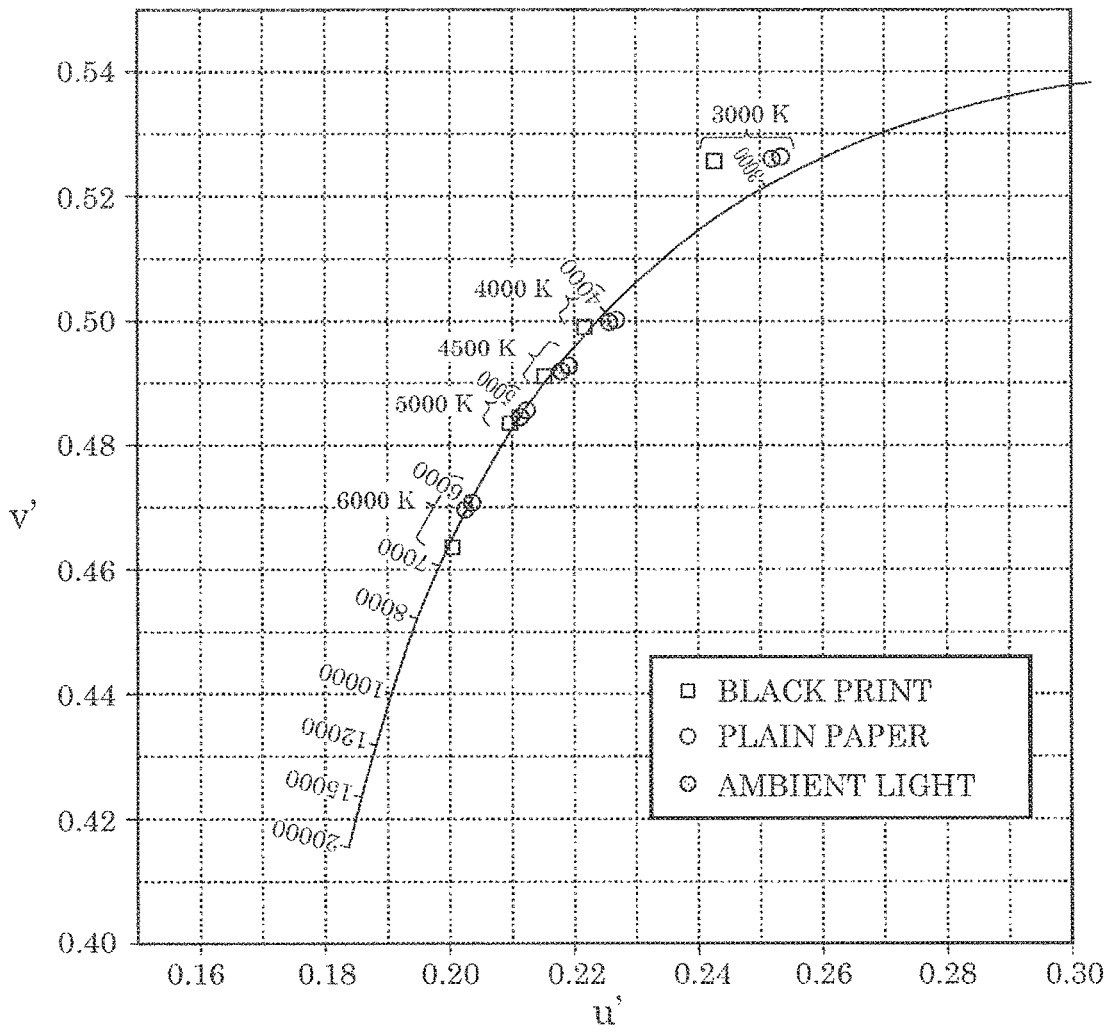
FIG. 6 is a graph illustrating chromaticity of unmarked plain paper (white) and chromaticity of black print with respect to illumination light of a plurality of color temperatures.
Figure 7:
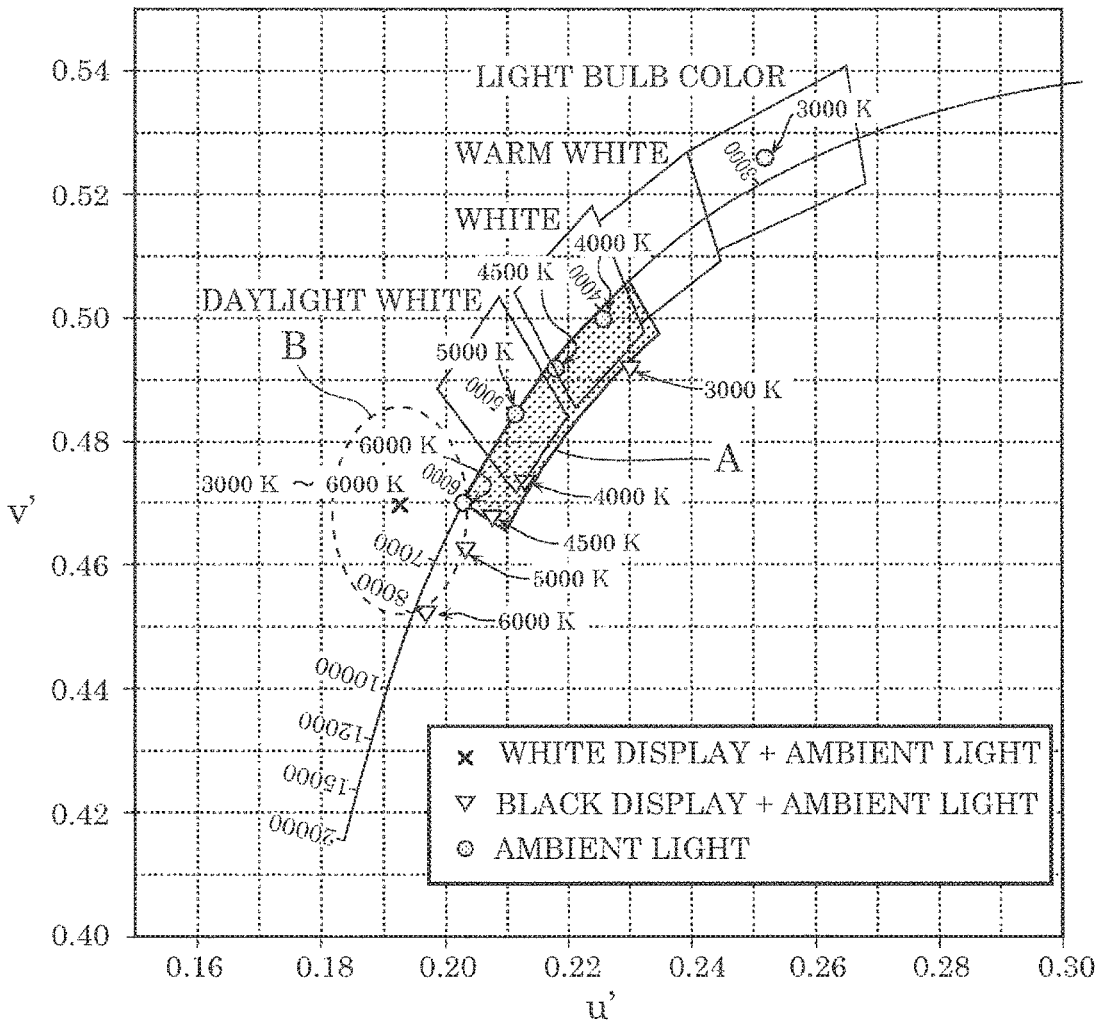
FIG. 7 is a graph illustrating chromaticity of a white display and chromaticity of a black display on a display with respect to illumination light of a plurality of color temperatures.

In view of this, the inventors considered that, even when the screen settings of the display are left in the initial state, readability of characters on the display can be facilitated by enhancing the whiteness perception of the display through the illumination light of a lighting apparatus. Based on this underlying knowledge, the inventors changed the color temperature of the illumination light (ambient light) of a light apparatus, and measured and analyzed the chromaticity of characters on paper and characters on a display. The results are illustrated in FIG. 6 and FIG. 7. It should be noted that the display used in this embodiment is, for example, a liquid-crystal display which is the most generic at present, but is not limited to such.

FIG. 6 illustrates the chromaticity of illumination lights when color temperature is at 3000 K, 4000 K, 4500 K, 5000 K, and 6000 K, and the chromaticity of unmarked plain paper (white) and the chromaticity of black print when each of these illumination lights are used as ambient light. FIG. 7 illustrates the chromaticity of illumination lights when color temperature is at 3000 K, 4000 K, 4500 K, 5000 K, and 6000 K, and the chromaticity of a white display and the chromaticity of a black display on the display when each of these illumination lights are used as ambient light.

As illustrated in FIG. 6, with regard to paper, although the color difference (Δ u'v') between plain paper (white) and black print increases slightly in the cases where illumination light (ambient light) is 6000 K and 3000 K, it can be seen that the chromaticity (u', v') of plain paper under ambient light substantially coincides with the chromaticity (u', v') of ambient light. In other words, using illumination light having high color temperature that enhances whiteness perception as ambient light facilitates character readability.

In contrast, as illustrated in FIG. 7, with regard to a display, when the display generates a white display, chromaticity (u', v') practically does not change even if the color temperature of ambient light changes. Conversely, when the display generates a black display, chromaticity changes more significantly than the change in the color temperature of the ambient light.

In this manner, it is understood that, unlike the chromaticity of black print on paper, the chromaticity of the black display on the display changes more significantly than the change in the color temperature of ambient light (illumination light).

It is thought that, in the black display portion of a display such as a liquid-crystal display device, the light of the backlight is transmitted to some extent, but since the amount of light transmitted is small, the black display portion is easily affected by the reflected light of the illumination light at the surface of the display screen of the display, and thus chromaticity changes significantly. In other words, unlike the black print on paper, the black display on the display has a shade and is easily affected by illumination light.

Therefore, it is understood that, in order to improve the readability perception of characters displayed on a display, it is necessary to pay attention not only to whiteness perception but also to blackness perception.

In view of this, the inventors studied the optical characteristics of ambient light (illumination light) that is suited to reading and writing of characters and capable of enhancing legibility of characters on the display to thereby improve the readability perception of characters on the display.

Specifically, it is thought that, by making the color difference of the display under ambient light (Δu'v'=white display chromaticity−black display chromaticity) bigger than the color difference of illumination light having a color temperature of 5000 K which is widely used as typical ambient light, and using an illumination light having a light color classification recognizable as white light, based on the results in FIG. 6 and FIG. 7, it is possible to realize a pleasant illumination space with improved readability perception of characters on a display and without discomfort during reading and writing of characters.

Figure 8:
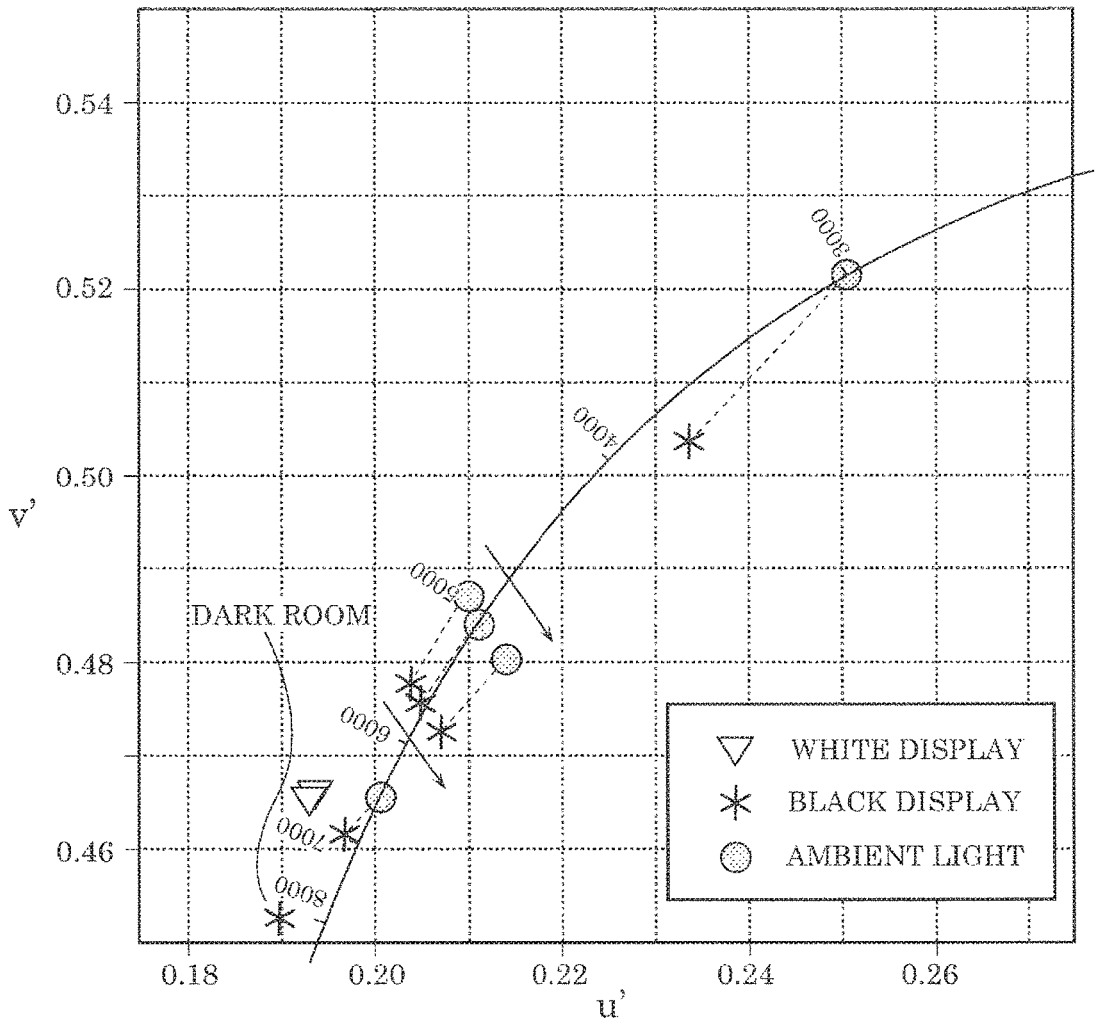
FIG. 8 is a graph illustrating the relationship between the chromaticity deviation of ambient light and the respective chromaticities of the black display and the white display on a display under the ambient light.

Here, by studying the relationship between chromaticity deviation (Duv) of ambient light and the respective chromaticities of black display and white display on the display under ambient light, the results illustrated in FIG. 8 were obtained. In FIG. 8, a combination indicated by a broken line represents a combination of the chromaticity of a certain ambient light and the chromaticity of a black display on a display under such ambient light. As illustrated in FIG. 8, it can be seen that when the ambient light moves in the chromaticity deviation negative-side direction (the direction indicated by arrows in the graph), the black display on the display also moves in the negative-side direction.

Figure 9:
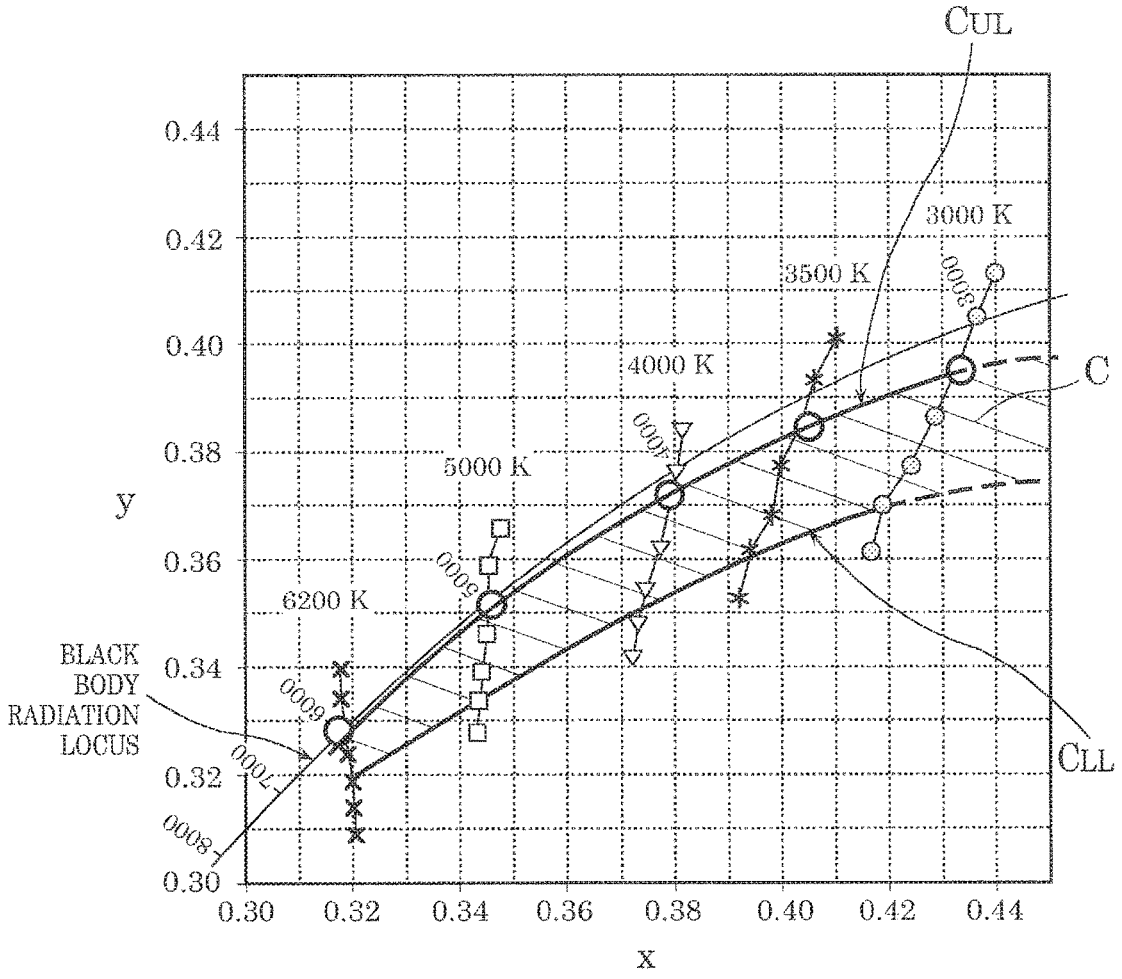
FIG. 9 is a graph illustrating the relationship between the shade of paper and readability perception of paper in an xy chromaticity diagram.

On the other hand, with regard to the relationship between the chromaticity deviation of ambient light and the whiteness perception of characters on paper, the inventors obtained the results illustrated in FIG. 9. FIG. 9 is a graph showing a character appearance whiteness perception improvement region C for paper obtained through the color-naming method and magnitude estimation method disclosed in Japanese Unexamined Patent Application Publication No. 2016-062887. In FIG. 9, allowable lower limit curve CLL of character appearance whiteness perception improvement region C represents a curve obtained by connecting the chromaticities when the chromaticity deviation Duv of the correlated color temperature of illumination lights having respective color temperatures of 3000 K, 3500 K, 4000 K, 5000 K, and 6200 K is −12. Furthermore, allowable upper limit curve CUL of character appearance whiteness perception improvement region C is a lowest shade curve along which whiteness perception is strongest, and represents a curve obtained by connecting the chromaticities when the chromaticity deviation Duv of the correlated color temperature of illumination lights having respective color temperatures of 3000 K, 3500 K, 4000 K, 5000 K, and 6200 K is −3.

Since there is the possibility that paper, etc., with characters written thereon is also present nearby when a display is used, the light color range for satisfying the character appearance whiteness perception improvement region C is considered to be a region that should also be satisfied when improving the readability perception of characters on a display. Furthermore, the lower limit value of a white light source is shown in JISZ9112-2012 "Classification of fluorescent lamps/LEDs by light source color and color rendering property". Satisfying this lower limit value is also preferable for a light source to be used in an indoor illumination space.

In addition, it is considered that if the color temperature of ambient light is not lower than that of the display, the whiteness perception of the display deteriorates.

In view of the foregoing as a whole, it is considered that, in order to realize a pleasant illumination space with improved readability perception of characters on a display and without discomfort during reading and writing of characters, the ambient light should be a light in the range of the ambient light optimal region A illustrated in FIG. 7 (region indicated by hatching in FIG. 7).

Specifically, the ambient light should have optical characteristics in which correlated color temperature is at least 3800 K and at most 6500 K and chromaticity deviation is at least −9 and at most 0. Accordingly, since it is possible to provide not only whiteness perception but also blackness perception, it is possible to realize a pleasant illumination space with improved readability perception of characters on a display through enhanced contrast and without discomfort during reading and writing of characters.

More specifically, the ambient light should have optical characteristics in which correlated color temperature is at least 4500 K and at most 6500 K and chromaticity deviation is at least −6 and at most −2. Accordingly, it is possible to provide higher whiteness perception and higher blackness perception. With this, readability perception of characters on the display is further improved.

At this time, in FIG. 7, the aforementioned ambient light optimal region A which is the chromaticity of black display on the display is set in the region beyond the range of SDCM 15 (region B surrounded by broken line in FIG. 7) from the chromaticity of the white display on the display under ambient light. By setting beyond the range of SDCM 15, it is possible to reliably recognize the difference from the chromaticity of the black display on the display. In this case, it is sufficient to set the correlated color temperature of ambient light to at most 6000 K.

Here, in order to check the advantageous effects of the above-described optical characteristics, an experiment was performed with regard to the readability perception of characters on a display.

Figure 10A:
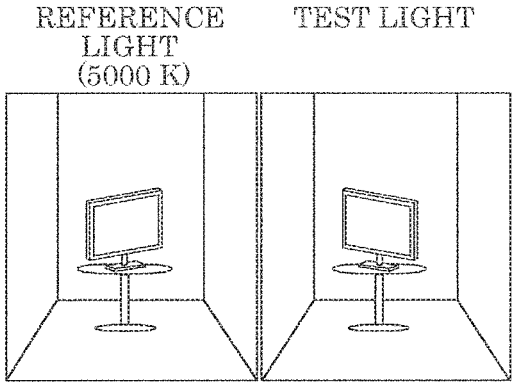
FIG. 10A is a diagram illustrating a layout of displays during performance of an experiment regarding readability perception of characters on a display.

In the experiment, as illustrated in FIG. 10A, a 23-inch liquid-crystal display (MouseComputer Co., Ltd. iiyama ProLite X2382HS; brightness: 200 cd/m$^2$) is placed, as a viewed object, on a table (height: 700 mm) inside each of two booths (interior dimensions: 2.2 m×2.2 m×2.2 m; interior finishing: white walls, 75% reflectivity), and subjective evaluation of images displayed on the display screen of the liquid-crystal displays in ambient light produced by illumination light is carried out.

Specifically, a reference light is emitted as illumination light in one booth, and test lights are emitted as illumination lights in the other booth. For the reference light, a general-purpose office light (illuminance level: 750 lx) having a color temperature of 5000 K and a chromaticity deviation Duv of 0 is used. For the test lights, lights having color temperatures (chromaticity deviation Duv: 0) at 6 levels of 3000 K, 3800 K, 4500 K, 5000 K, 6200 K, and 6500 K were used. Moreover, for the 3800 K, 4500 K, and 5000 K lights only, lights having chromaticity deviation Duv at 5 levels of −6, −4, −2, 0, and 2 were used. In other words, for the test lights, lights for a total of 18 conditions are used.

Figure 10B:
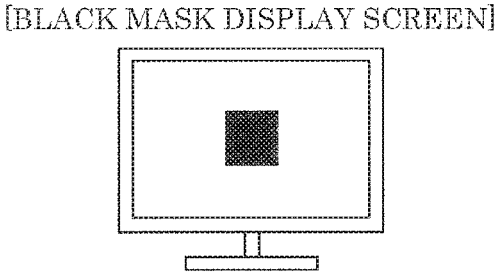
FIG. 10B is a diagram illustrating an example of a black mask screen displayed on a display.
Figure 10C:
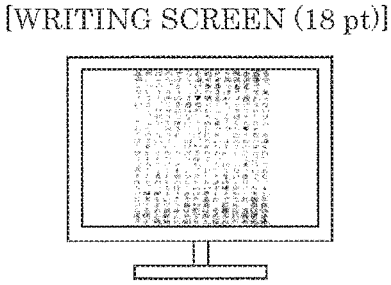
FIG. 10C is a diagram illustrating an example of a writing screen displayed on a display.
Figure 10D:
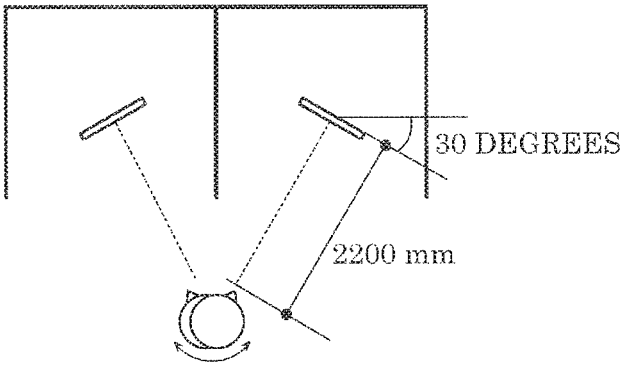
FIG. 10D is a diagram illustrating movement of a test subject during performance of an experiment regarding readability perception of characters on a display.

In the experiment, as illustrated in FIG. 10B, a black mask (105 mm×105 mm) on a white background is displayed on the display screen of the liquid-crystal displays and test subjects were made to evaluate the "whiteness perception" and "blackness perception" of the display screens. Furthermore, as illustrated in FIG. 10C, writing (approximately 1,200 characters) is displayed on the display screen of the liquid-crystal displays, and the test subject is made to evaluate the "readability perception" of the characters. It should be noted that, men and women combined, there were 12 test subjects (age: 26 to 53 years old). Moreover, as illustrated in FIG. 10D, each test subject was made to compare and evaluate the 2 booths by rotating his/her chair so as squarely face the front of the respective liquid-crystal displays.

Next, the specific test procedure is described. First, both booths are illuminated using the illumination light of the reference light (color temperature: 5000 K; chromaticity deviation Duv: 0) and adaptation and experiment explanation were carried out for 5 minutes. Subsequently, the illumination light of one booth (the booth on the left in FIG. 10A) is fixed to the reference light and the illumination light of the other booth (the booth on the right in FIG. 10A) is sequentially changed, as the test lights.

Figure 11:
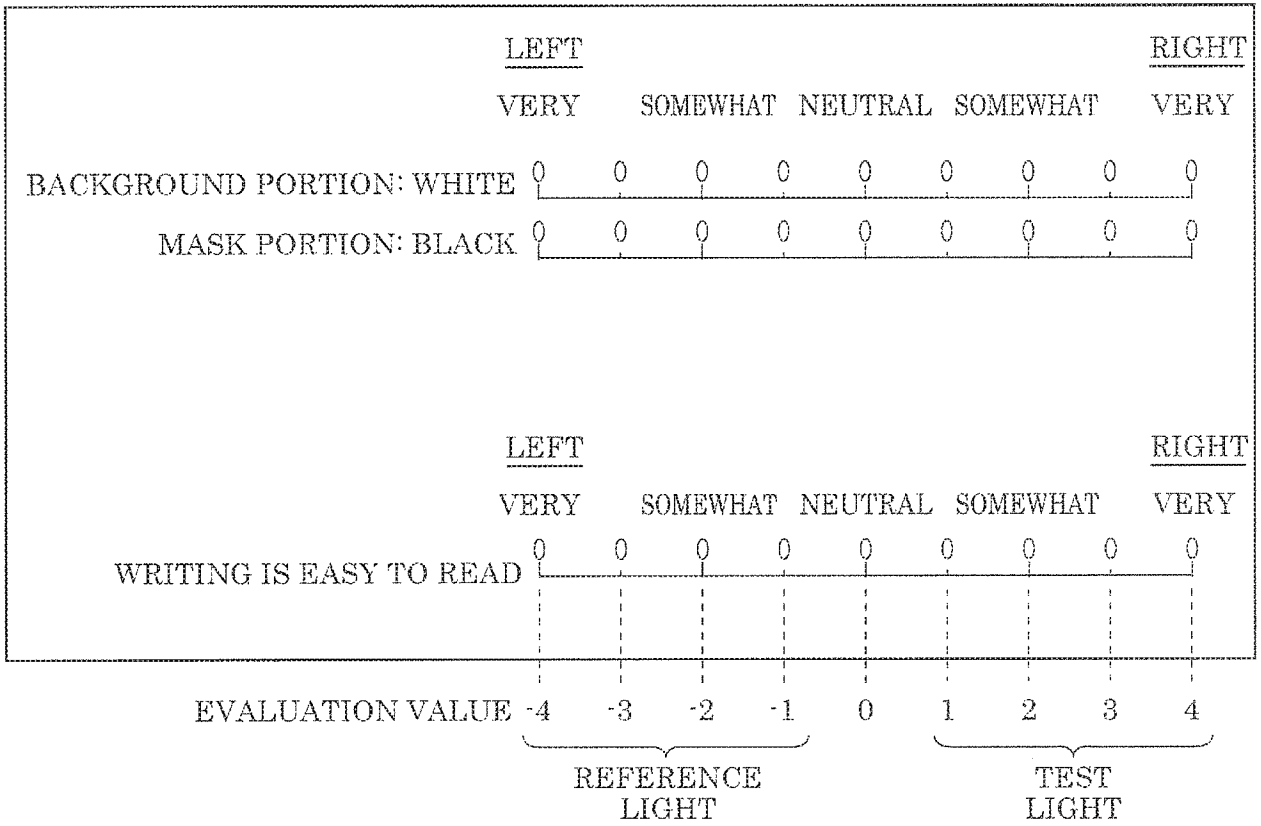
FIG. 11 is a diagram illustrating an entry form during performance of an experiment regarding readability perception of characters on a display.

With the observation time for the test subjects set at 30 seconds, the task of entering the evaluation result onto the entry form (evaluation form) illustrated in FIG. 11 according to instructions to "perform evaluation" from a tester was repeated by each test subject, and this was executed for the three sections described below.

In the first section, a black mask (FIG. 10B) is displayed on the display screen of the liquid-crystal displays, and test lights in which color temperature (chromaticity deviation Duv: 0) is at six levels of 3000 K, 3800 K, 4500 K, 5000 K, 6200 K, and 6500 K were evaluated twice, in ascending series and descending series. It should be noted that the test light having a color temperature of 6500 K is evaluated once.

In the second section, a black mask (FIG. 10B) is displayed on the display screen of the liquid-crystal displays, and test lights in which correlated color temperatures is 5000 K and chromaticity deviation Duv is at five levels of −6, −4, −2, 0, and 2, are evaluated twice, in ascending series and descending series. Subsequently, the same evaluation is performed for the correlation color temperatures 4500 K and 3800 K. It should be noted that, for each correlated color temperature, the test light in which chromaticity deviation Duv is 2 is evaluated once.

In the third section, 18 pt. writing (FIG. 10C) quoted from Tensei Jingo is displayed on the display screens of the liquid-crystal displays, and the test lights were evaluated by dividing the 12 test subjects into 2 groups of 6 persons each. Specifically, test lights having color temperatures (Duv: 0) at 6 levels of 3000 K, 3800 K, 4500 K, 5000 K, 6200 K. and 6500 K were evaluated once in the stated order by one group. At this time, the test lights having the color temperatures 3800 K, 4500 K, and 5000 K were evaluated with chromaticity deviation Duv at 5 levels of 2, 0, −2, −4, and −6. Furthermore, test lights having color temperatures (Duv: 0) at 6 levels of 6500 K, 6200 K, 5000 K, 4500 K, 3800 K, and 3000 K were evaluated once in the stated order by the other group. At this time, the test lights having the color temperatures 3800 K, 4500 K, and 5000 K were evaluated with chromaticity deviation Duv at 5 levels of −6, −4, −2, 0, and 2.

Next, the analysis results of the experiment performed in the above manner will be described below. Specifically, the results of the 9-stage subjective evaluation using the entry form illustrated in FIG. 11 were analyzed, and the proportion of people that chose an evaluation which was relatively in favor of the reference light (evaluation with an evaluation value of −4, −3, −2, −1), the proportion of people that chose an evaluation which was relatively in favor of the test lights (evaluation with an evaluation value of 1, 2, 3, 4), and the proportion of people that chose a neutral evaluation (evaluation with an evaluation value of 0) was calculated for the 18 conditions (18 types) of lights. The results are illustrated in FIG. 12 to FIG. 14.

Figure 12:
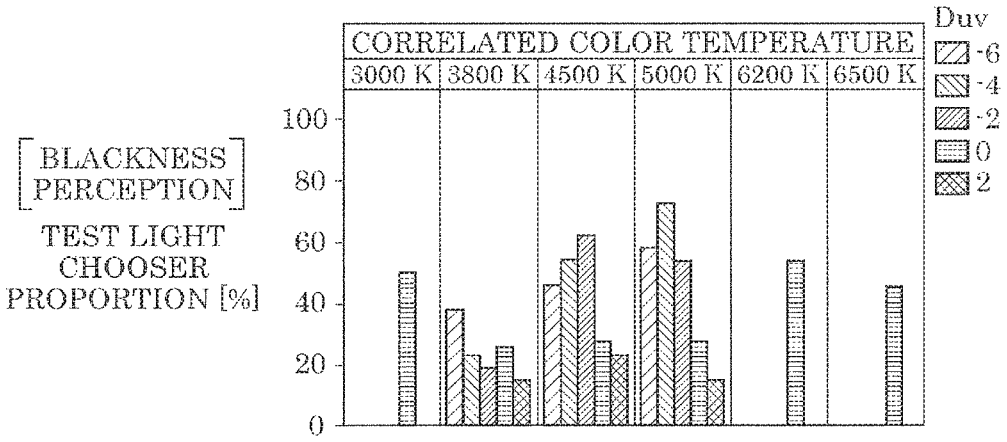
FIG. 12 is a graph illustrating results of an experiment regarding blackness perception of test lights.

FIG. 12 illustrates the proportion of people that evaluated the test light as having higher "blackness perception" than the reference light. FIG. 13 illustrates the proportion of people that evaluated the test light as having higher "whiteness perception" than the reference light. With regard to "readability perception", a 9-stage evaluation result is illustrated in FIG. 14 so that the level of readability can be understood.

Figure 13:
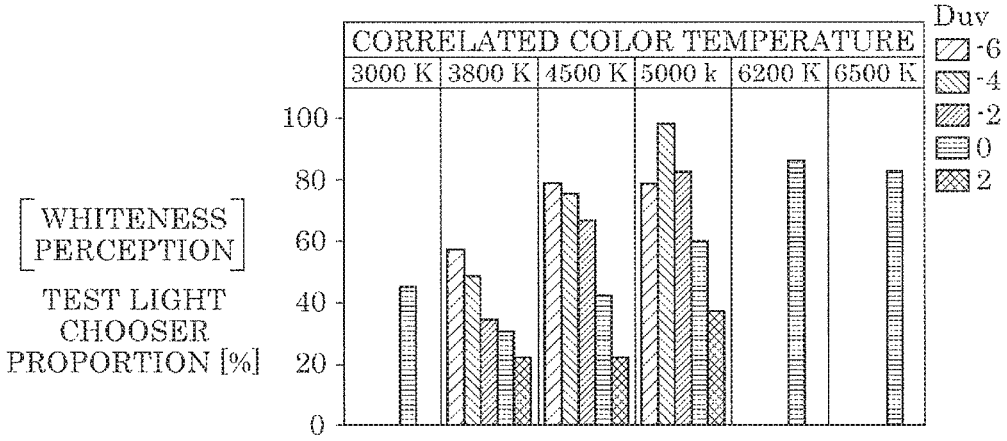
FIG. 13 is a graph illustrating results of an experiment regarding whiteness perception of test lights.

From the results shown in FIG. 12 and FIG. 13, it can be seen that with regard to the "whiteness perception" and "blackness perception" of the display screens of the liquid-crystal displays, the illumination light having a color temperature of 5000 K and a chromaticity deviation Duv of −4 shows the highest evaluation value.

Figure 14:
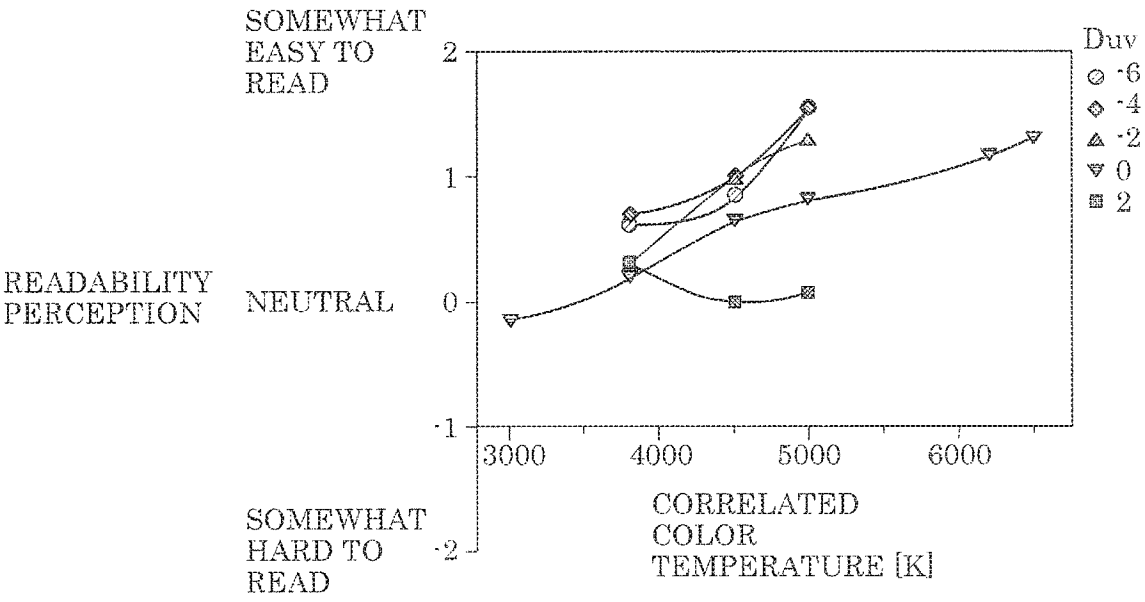
FIG. 14 is a graph illustrating results of an experiment regarding readability perception for test lights.

Furthermore, from the results illustrated in FIG. 14, it can be seen that, even with regard to the "readability perception" of characters on the liquid-crystal displays, the illumination light having the color temperature of 5000 K and the chromaticity deviation Duv of −4 shows the highest evaluation value.

It should be noted that, since adaptation may not have been sufficiently taken into account in the above-described experiment using pair-wise comparison, an experiment using evaluation on an absolute scale with 15 test subjects was also carried out. Here, as illumination lights, lights (illuminance level: 750 lx) for 25 conditions such as color temperatures at 5 levels of 4200 K, 4600 K, 5000 K, 5500 K, and 6200 K, and chromaticity deviation at 5 levels of 2, 0, −2, −4, and −6, were used. The same liquid-crystal displays as those in the foregoing experiment were used and writing having approximately 1200 characters was used as a viewed object.

An adjustment method is used as the experimentation method, and the tone of the characters was changed from a white level to a black level in 86 steps with the white level being 255 and the black level being 0.

The test subjects were made to perform evaluations twice: once in a descending series where the "minimum level at which black is perceived" for the color of the displayed characters is changed from the white level to the black level, and once in an ascending series where it is changed from the black level to the white level. The result of performing contour-line processing from the average values of the adjustment levels is illustrated in FIG. 15.

Figure 15:
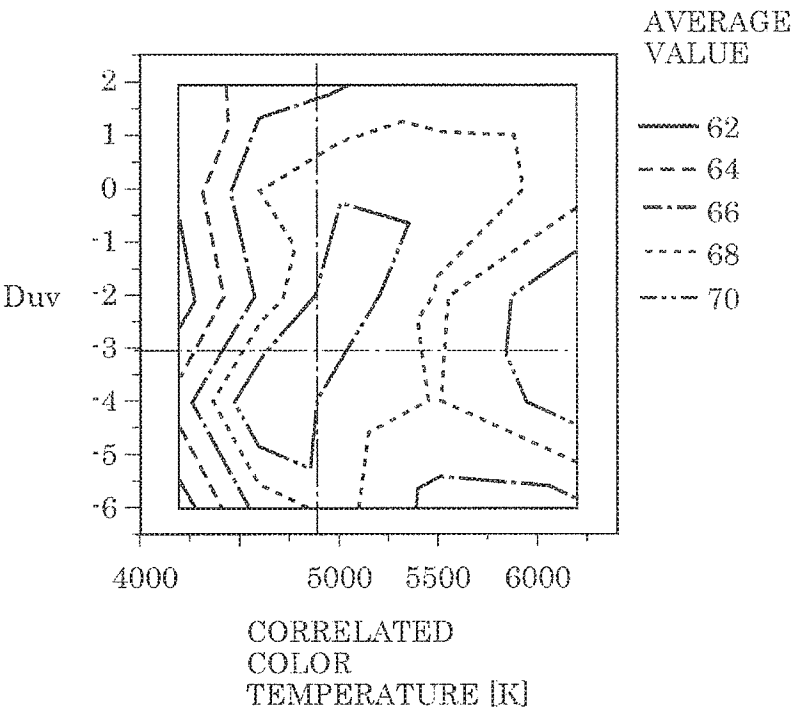
FIG. 15 is a graph illustrating the distribution of contour lines according to evaluation on an absolute scale of correlated color temperature and chromaticity deviation.

As illustrated in FIG. 15, it is apparent that, even in a faint black level of 70/255 with respect to white level 255, there is a region that is perceived to be black. In this manner, if there is a region that is recognized as black even in a faint black level due to the illumination light, then this means that, even with an identical black display, there is a region that can be perceived as being blacker due to the illumination light.

From this experiment, it was understood that the light color region of illumination light that is recognizable as being black at a faint black level 70/255 is in a range where color temperature is at least 4500 K and at most 5300 K and chromaticity deviation Duv is at least −5 and at most −1. Furthermore, the light color region of illumination light that is recognizable as being black at a black level 67/255 is in a range where color temperature is at least 4300 K and at most 6500 K and chromaticity deviation Duv is at least −6 and at most 1.

In this manner, it is understood that by setting, to within predetermined ranges, the color temperature and chromaticity deviation of the illumination light which is to serve as ambient light, it is possible to realize a pleasant illumination space with improved readability perception of characters on a display and without discomfort during reading and writing of characters.

In recent years, experiment results have been obtained which indicate that pupil diameter decreases and pupil constriction occurs when the ipRGC stimulus level is high. ipRGCs are a third class of photoreceptor cells following the pyramidal cells and the rod cells, and is known to respond most efficiently to light having a wavelength of 493 nm.

With the constriction of the pupil diameter, the depth of field becomes deep so that an in-focus state for the viewed object is easily obtained. Specifically, the higher the ipRGC stimulus amount is, the more the viewed object, such as characters, is in focus, and the legibility of the characters, etc., improves.

Figure 16:
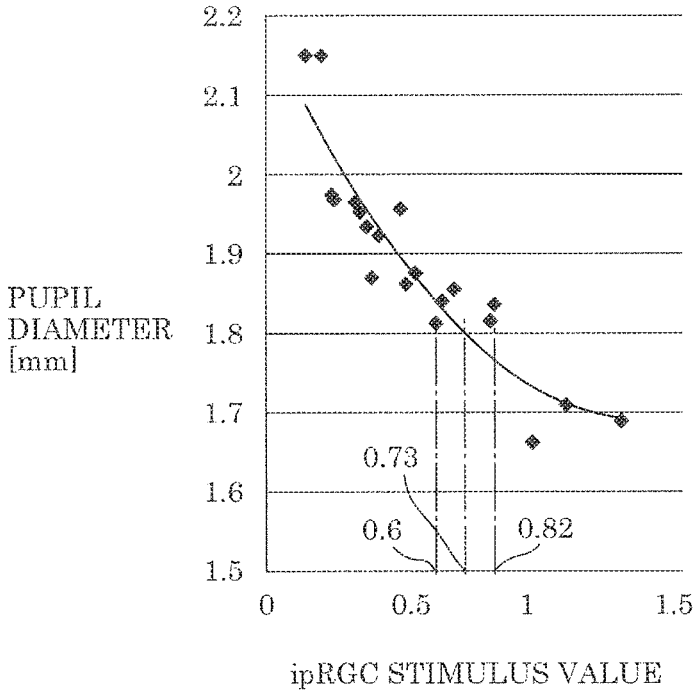
FIG. 16 is a graph illustrating the relationship between ipRGC stimulus amount and pupil diameter.

Here, the relationship between ipRGC stimulus amount and pupil diameter is illustrated in FIG. 16. FIG. 16 is a graph illustrating the relationship between ipRGC stimulus amount and pupil diameter, and shows a graph obtained by plotting experiment results for a plurality of people. It should be noted that, in FIG. 16, the average values for test subjects in their twenties and forties have been processed.

Furthermore, the relationship between the color temperature of light and ipRGC stimulus amount is illustrated in table 1.

It should be noted that in FIG. 16 and Table 1, the ipRGC stimulus amount is indicated using a value standardized according to the light emitted from a D65 light source. The D65 light source is one standard light source prescribed by the Commission Internationale de l'Eclairage (CIE).

TABLE 1

| | CHROMATICITY | | CORRELATED COLOR TEMPERATURE | | ipRGC STIMULUS |
|---|---|---|---|---|---|
| | X | Y | [K] | Ra | VALUE |
| A (5000 K) | 0.3467 | 0.3530 | 4945 | 84 | 0.73 |
| B (COMBINED LIGHT 1) | 0.3540 | 0.3575 | 4697 | 85 | 0.70 |
| C (COMBINED LIGHT 2) | 0.3591 | 0.3606 | 4538 | 85 | 0.69 |
| D (COMBINED LIGHT 3) | 0.3880 | 0.3782 | 3809 | 85 | 0.60 |
| E (3000 K) | 0.4458 | 0.4134 | 2930 | 86 | 0.44 |

As indicated in Table 1, the ipRGC stimulus amount when the color temperature which is typically widely used for ambient light is 5000 K is 0.73. Therefore, it can be understood from FIG. 16 that, in order to obtain the same pupil constriction effect as with the 5000 K light, a ipRGC stimulus amount of approximately at least 0.6 is needed.

Here, as illustrated in Table 1, ipRGC stimulus amount increases as the correlated color temperature of light increases, and decreases as the correlated color temperature of light decreases. As such, with a light having a low color temperature, the pupil constriction effect decreases and focusing becomes difficult. Therefore, in order to maintain character readability perception, it is important to ensure at least a certain ipRGC stimulus amount.

From the results of the foregoing study, the inventors have found an illumination light having optical characteristics capable of enhancing contrast and improving the readability perception of characters on a display by enhancing the blackness perception and whiteness perception of the display while maintaining the readability perception of characters on both display and paper by ensuring the ipRGC stimulus amount.

Figure 17:
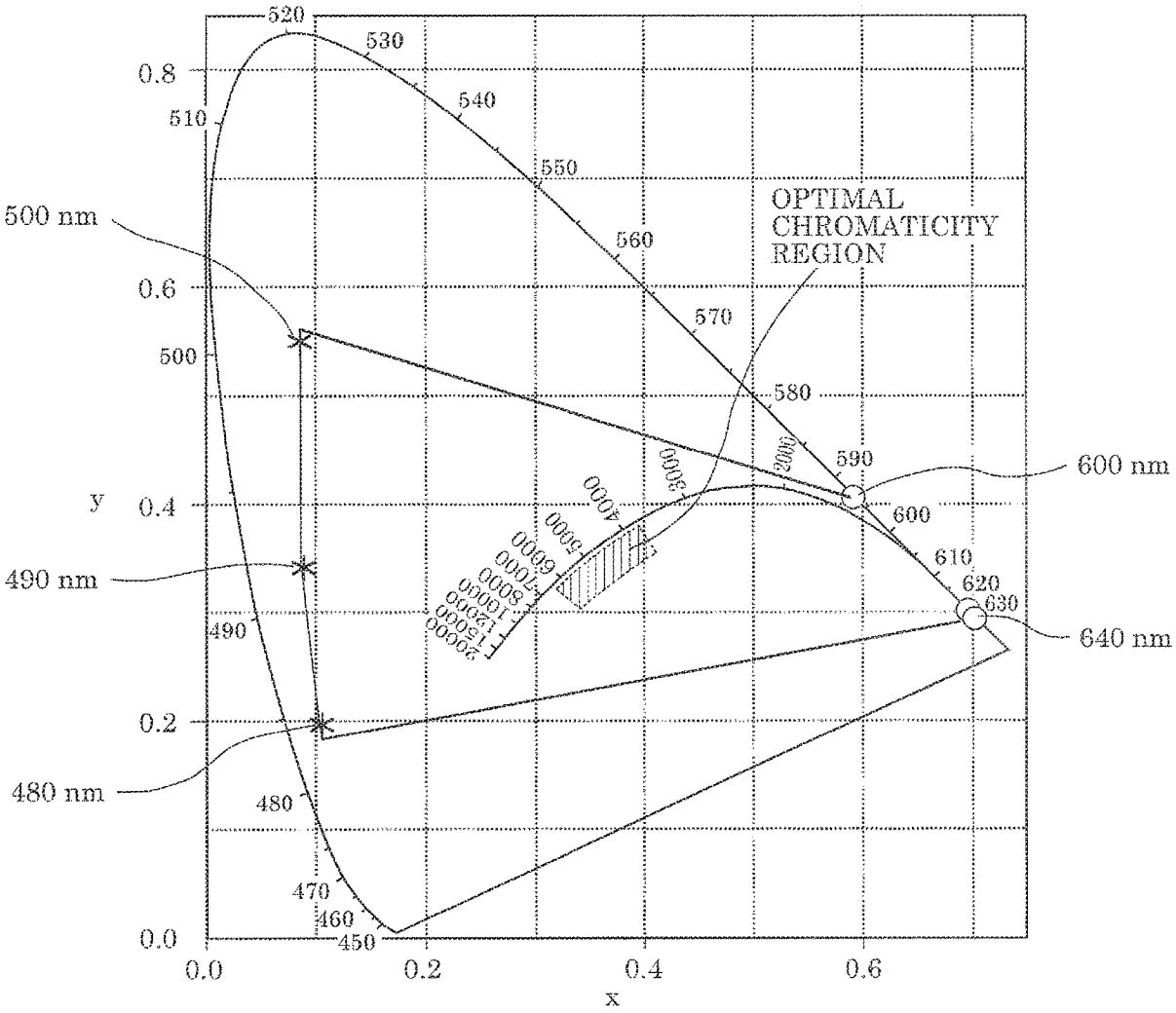
FIG. 17 is a chromaticity diagram illustrating an optimal chromaticity region of a first illumination light emitted by the light emitter of the lighting apparatus according to the embodiment.

Specifically, the optical characteristics of the first illumination light emitted from light emitter 100 of lighting apparatus 1 is in an optimal chromaticity region (region surrounded by a broken line in FIG. 17) where correlated color temperature ranges from 3800 K to 6500 K, inclusive, and chromaticity deviation Duv ranges from −9 to 0, inclusive, and ipRGC stimulus amount is set to be at least 0.6 using a value standardized according to the light emitted from a D65 light source.

Accordingly, it is possible to realize a pleasant illumination space with improved readability perception of characters on a display and without discomfort during reading and writing of characters.

Furthermore, in lighting apparatus 1 according to this embodiment, light emitter 100 emits the aforementioned first illumination light as display illumination when in the display illumination mode.

Accordingly, in the display illumination mode, readability perception of characters in a document improves and readability perception of characters on a display improves. Specifically, increased efficiency in reading and writing of characters on a document and increased efficiency in viewing characters on a display can both be achieved.

Furthermore, in this embodiment, in lighting apparatus 1, light source unit 10 (light emitter 100) emits the second illumination light as a document illumination light in the document illumination mode. The optical characteristics of the second illumination light are: correlated color temperature ranges from 5400 K to 7000 K, inclusive; chromaticity deviation Duv ranges from −6 to 8, inclusive, and the chroma value calculated using a calculation method prescribed by the CIE 1997 Interim Color Appearance Model (Simple Version) is at most 2.0.

Accordingly, by switching lighting apparatus 1 to the document illumination mode when there is no need to look at characters on a display, lighting apparatus 1 emits illumination light (second illumination light) that is better suited to reading characters in a document than the first illumination light.

It should be noted that, in this embodiment, LED elements 120 only use white LED light sources of at least one type such as first LED elements 120*a* and second LED elements 120*b*.

Accordingly, lighting apparatus 1 capable of emitting the first illumination light having the above-described optical characteristics can be realized at low cost.

(Variations)

In the foregoing embodiment, the first illumination light having the above-described optical characteristics is realized by using, as LED elements 120, the two types of white LED light sources, namely, white LED light sources that emit white light having a correlated color temperature of 6500 K and white LED light sources that emit white light having a correlated color temperature of 2700 K, but is not limited to such. Other forms of LED elements 120 for realizing the first illumination light having the above-described optical characteristics will be described below.

(Variation 1)

In this variation, the first illumination light having the above-described optical characteristics is realized using, as LED elements 120, white LED light sources that emit white light having a correlated color temperature of at least 5000

K and at most 7200 K and red LED light sources that emit red light having a main peak wavelength in a range from 600 nm to 650 nm, inclusive.

Figure 18:
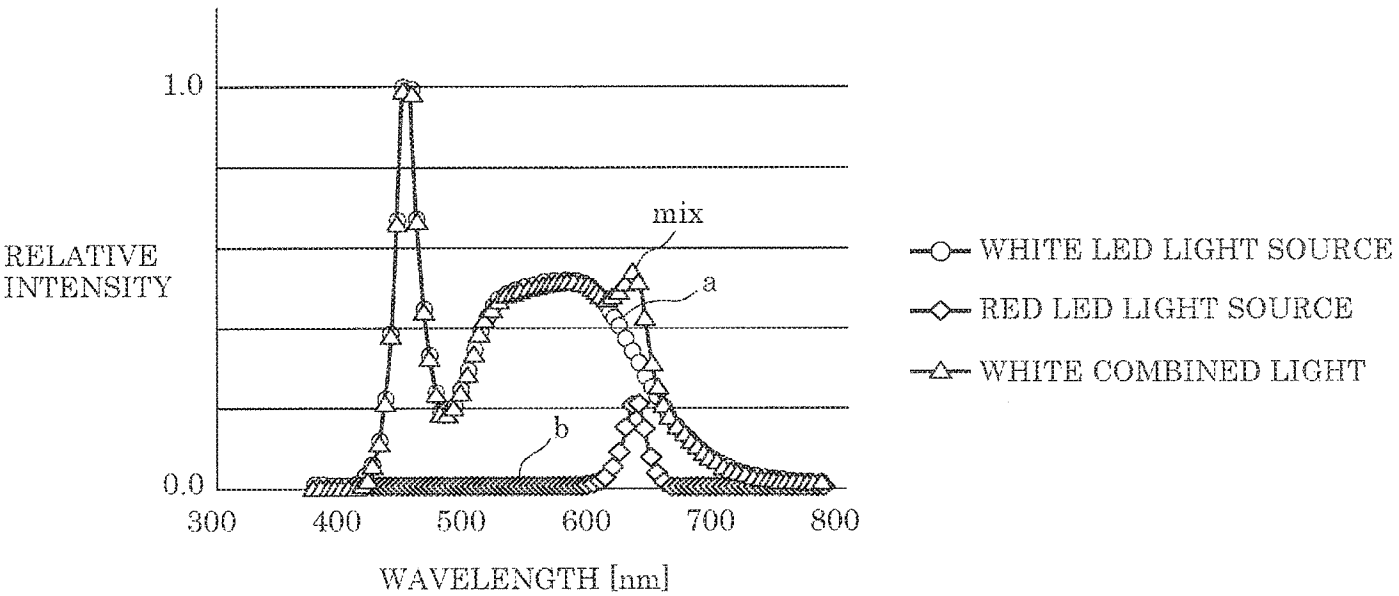
FIG. 18 is a graph illustrating a spectral distribution of the light emitter and LED elements of the lighting apparatus according to Variation 1.

In this case, in the foregoing embodiment, first LED elements 120*a* may be white LED light sources and second LED elements 120*b* may be red LED light sources. At this time, first LED elements 120*a* (white LED light sources) emit light having spectral distribution "a" illustrated in FIG. 18, second LED elements 120*b* (red LED light sources) emit light having spectral distribution "b" illustrated in FIG. 18, and when all first LED elements 120*a* and all second LED elements 120*b* emit light, light emitter 100 emits light having spectral distribution "mix" illustrated in FIG. 18.

In this manner, by combining existing white LED light sources having a correlated color temperature of at least 5000 K and red LED light sources to realize the above-described first illumination light, it is possible to efficiently switch between the existing light and the first illumination light, in addition to realizing a pleasant illumination space with improved readability perception of characters on a display and without discomfort during reading and writing of characters. It should be noted that, as second LED elements 120*b*, red LED light sources having a main peak wavelength in a range from 620 nm to 640 nm, inclusive, may be used.

(Variation 2)

In this variation, the first illumination light having the above-described optical characteristics is realized by using, as LED elements 120, white LED light sources that emit white light having a correlated color temperature of at least 5000 K and at most 7200 K, white LED light sources that emit white light having a correlated color temperature of at least 2700 K and at most 3800 K, and red LED light sources that emit red light having a main peak wavelength in a range from 600 nm to 650 nm, inclusive.

Figure 19:
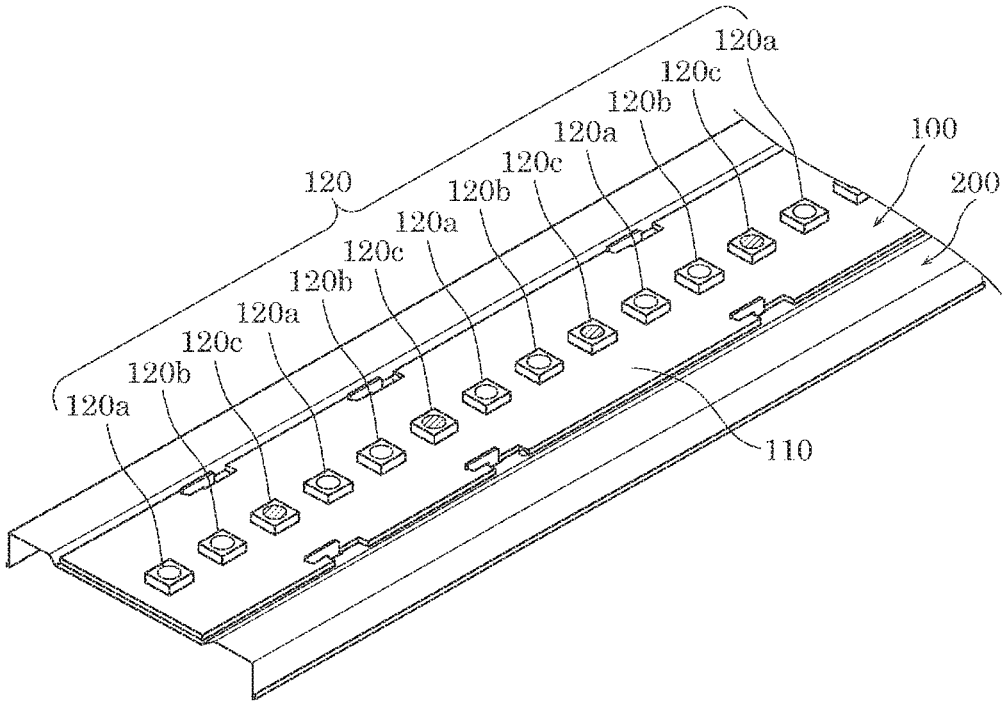
FIG. 19 is a diagram illustrating a configuration of a light emitter of a lighting apparatus according to Variation 2.

In this case, as illustrated in FIG. 19, LED elements 120 may be composed of first LED elements 120*a* which are high color temperature (for example, 6500 K) white LED light sources, second LED elements 120*b* which are low color temperature (for example, 2700 K) white LED light sources, and third LED elements 120*c* which are red LED light sources. It should be noted that although, in this variation, first LED elements 120*a*, second LED elements 120*b*, and third LED elements 120*c* are arranged in repeating sets, with each set having one of each, the arrangement order and the number of first LED elements 120*a*, second LED elements 120*b*, and third LED elements 120*c* are not limited to such.

Figure 20:
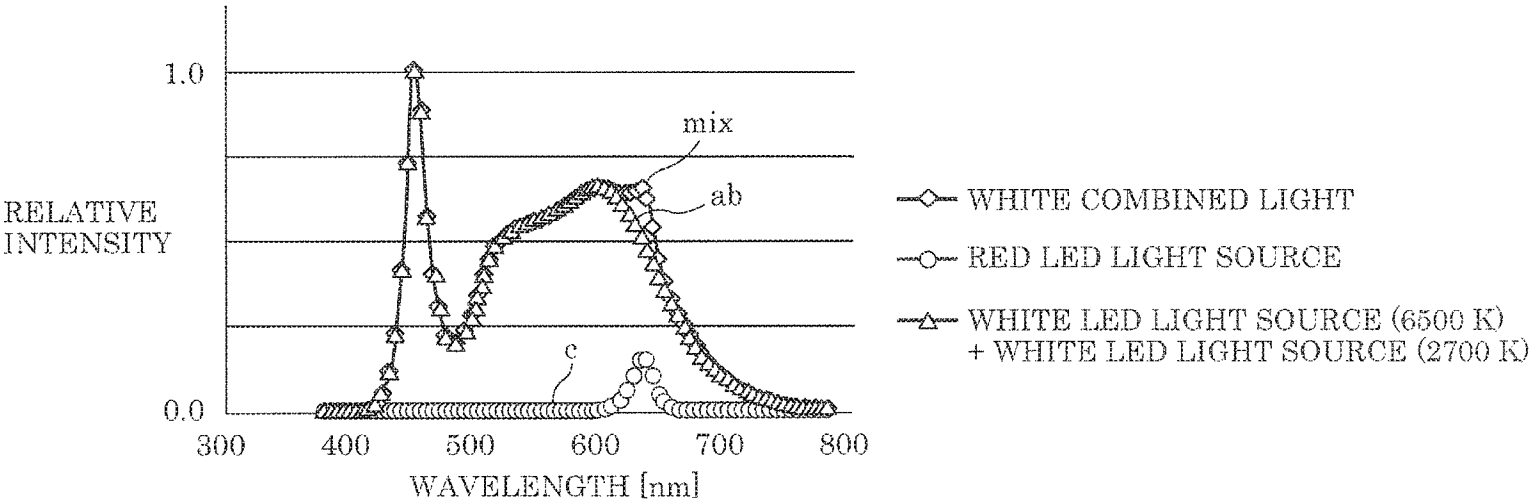
FIG. 20 is a graph illustrating a spectral distribution of the light emitter and LED elements of the lighting apparatus according to Variation 2.

At this time, first LED elements 120*a* (white LED light sources) and second LED elements 120*b* (white LED light sources) emit light having spectral distribution "ab" illustrated in FIG. 20, third LED elements 120*c* (red LED light sources) emit light having spectral distribution "c" illustrated in FIG. 20, and when all first LED elements 120*a*, all second LED elements 120*b*, and all third LED elements 120*c* emit light, light emitter 100 emits light having spectral distribution "mix" illustrated in FIG. 20.

In this manner, although color temperature is in the neighborhood of 5000 K and chromaticity deviation Duv is approximately −4 in Variation 1, by realizing the first illumination light by combining two types of white LED light sources and red LED light sources as in this variation, it is possible to make the chromaticity deviation Duv approximately −6, with the color temperature at 5000 K. Accordingly, it is possible to realize a first illumination light capable of further enhancing whiteness perception to provide higher contrast. Accordingly, it is possible to realize a pleasant illumination space with further improved readability perception of characters on a display and without discomfort during reading and writing of characters.

(Variation 3)

In this variation, the first illumination light having the above-described optical characteristics is realized by using, as LED elements 120, white LED light sources that emit white light having a correlated color temperature of at least 5000 K and at most 7200, red LED light sources that emit red light having a main peak wavelength ranging from 600 nm to 640 nm, inclusive, and green LED light sources that emit green light having a main peak wavelength in a range from 480 nm to 500 nm, inclusive.

Figure 21:
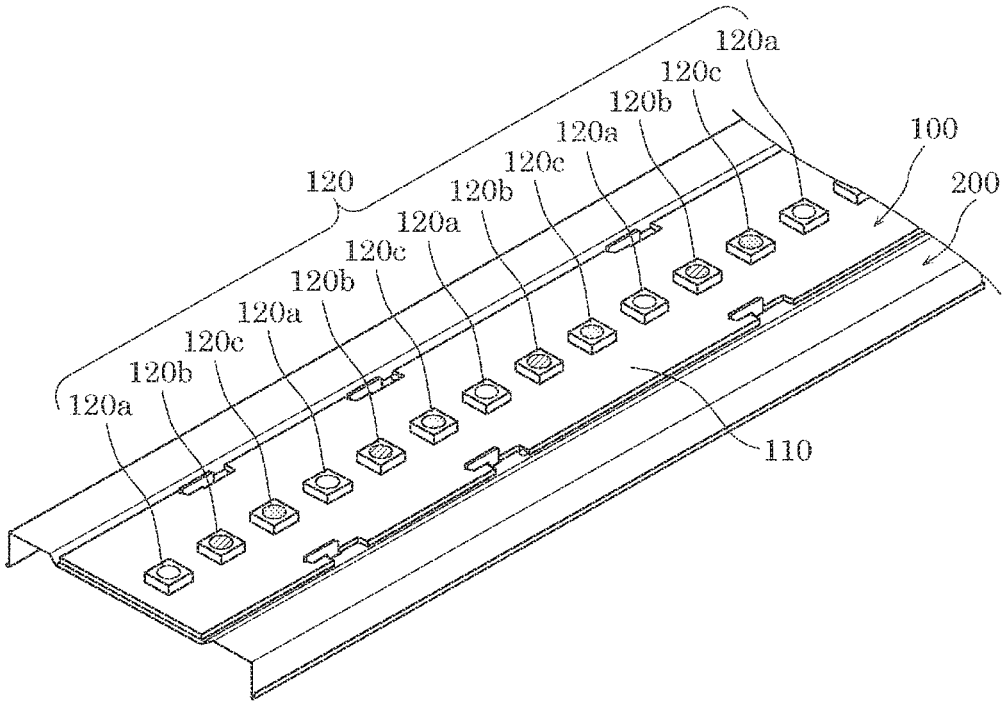
FIG. 21 is a diagram illustrating a configuration of a light emitter of a lighting apparatus according to Variation 3.

In this case, as illustrated in FIG. 21, LED elements 120 may be composed of first LED elements 120*a* which are white LED light sources, second LED elements 120*b* which are red LED light sources, and third LED elements 120*c* which are green LED light sources. It should be noted that although, in this variation, first LED elements 120*a*, second LED elements 120*b*, and third LED elements 120*c* are arranged in repeating sets, with each set having one of each, the arrangement order and the number of first LED elements 120*a*, second LED elements 120*b*, and third LED elements 120*c* are not limited to such.

Figure 22:
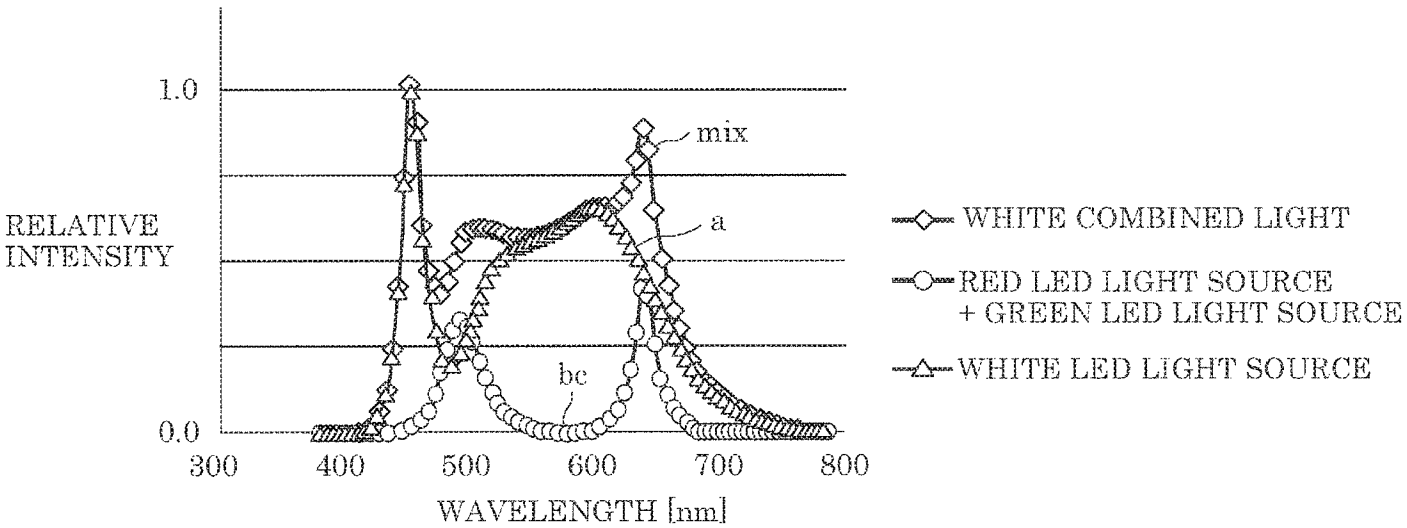
FIG. 22 is a graph illustrating a spectral distribution of the light emitter and LED elements of the lighting apparatus according to Variation 3.

At this time, first LED elements 120*a* (white LED light sources) emit light having spectral distribution "a" illustrated in FIG. 22, second LED elements 120*b* (red LED light sources) third LED elements 120*c* (green LED light sources) emit light having spectral distribution "bc" illustrated in FIG. 22, and when all first LED elements 120*a*, all second LED elements 120*b*, and all third LED elements 120*c* emit light, light emitter 100 emits light having spectral distribution "mix" illustrated in FIG. 22.

As in this variation, by realizing the first illumination light by adding red LED light sources and green LED light sources which have complementary colors, in addition to the white LED light sources, it is possible to reduce color irregularity on the light emitting surface (for example, the surface of light-transmissive cover 300) where color irregularity is noticeable, in addition to realizing a pleasant illumination space with improved readability perception of characters on a display and without discomfort during reading and writing of characters.

In this case, the red LED light sources and the green LED light sources may be arranged in close proximity, as illustrated in FIG. 21. Accordingly, color irregularity can be further reduced.

(Other Variations)

Although the lighting apparatus according to the present disclosure has been described based on an embodiment, the present disclosure is not limited to the foregoing embodiment.

For example, lighting apparatus 1 is permanently set onto a building material such as a ceiling in the foregoing embodiment but is not limited to such, and may be movable such as a stand light.

Furthermore, light emitter 100 is a SMD LED module in the foregoing embodiment but is not limited to such. For example, light emitter 100 may be a chip on board (COB) LED module. In this case, light emitter 100 includes substrate 110, one or more LED chip (bare chip) that is directly mounted onto substrate 110, as LED elements 120, and a sealing component made of a phosphor-containing resin, etc., that seals the LED chip.

In addition, in the foregoing embodiment, the first illumination light used as a display illumination light is likewise effective for use with a display device such as a projector. As such, the first illumination light may be used as a illumination for a projector.

Forms obtained by various modifications to the exemplary embodiment that can be conceived by a person of skill in the art as well as forms realized by arbitrarily combining structural components and functions in the exemplary embodiment which are within the scope of the essence of the present disclosure are included in the present disclosure.

What is claimed is:

1. A lighting apparatus, comprising:

a light emitter that emits a first illumination light as a display illumination light, wherein the first illumination light has, as optical characteristics:

a correlated color temperature in a range from 3800 K to 6500 K, inclusive;

chromaticity deviation Duv in a range from −9 to 0, inclusive; and an intrinsic photosensitive retinal ganglion cell (ipRGC) stimulus level of at least 0.6, the ipRGC stimulus level being a value standardized by setting an ipRGC stimulus level of light emitted from a D65 light source to 1.

2. The lighting apparatus according to claim 1, wherein the light emitter includes:

a white LED light source that emits white light having a correlated color temperature in a range from 5000 K to 7200 K, inclusive; and a white LED light source that emits white light having a correlated color temperature in a range from 2700 K to 3800 K, inclusive.

3. The lighting apparatus according to claim 1, wherein the light emitter includes:

a white LED light source that emits white light having a correlated color temperature in a range from 5000 K to 7200 K, inclusive; and a red LED light source that emits red light having a main peak wavelength in a range from 600 nm to 650 nm, inclusive.

4. The lighting apparatus according to claim 1, wherein the light emitter includes:

a white LED light source that emits white light having a correlated color temperature in a range from 5000 K to 7200 K, inclusive;

a white LED light source that emits white light having a correlated color temperature in a range from 2700 K to 3800 K, inclusive; and a red LED light source that emits red light having a main peak wavelength in a range from 600 nm to 650 nm, inclusive.

5. The lighting apparatus according to claim 1, wherein the light emitter includes:

a white LED light source that emits white light having a correlated color temperature in a range from 5000 K to 7200 K, inclusive;

a red LED light source that emits red light having a main peak wavelength in a range from 600 nm to 640 nm, inclusive; and a green LED light source that emits green light having a main peak wavelength in a range from 480 nm to 500 nm, inclusive.

6. The lighting apparatus according to claim 5, wherein the red LED light source and the green light source are arranged in close proximity.

7. The lighting apparatus according to claim 1, wherein the light emitter further emits a second illumination light as a document illumination light, the second illumination light has, as optical characteristics:

a correlated color temperature in a range from 5400 K to 7000 K, inclusive;

chromaticity deviation Duv in a range from −6 to 8, inclusive; and a chroma value of at most 2.0, the chroma value being calculated using a calculation method prescribed by the CIE 1997 Interim Colour Appearance Model (Simple Version).

* * * * *